US008017180B2

(12) United States Patent
Macedo

(10) Patent No.: US 8,017,180 B2
(45) Date of Patent: Sep. 13, 2011

(54) PROCESS FOR DECORATING A WOOD CELLULOSE WEB MATERIAL

(76) Inventor: Joseph Macedo, Basking Ridge, NJ (US)

( * ) Notice: Subject to any disclaimer, the term of this patent is extended or adjusted under 35 U.S.C. 154(b) by 0 days.

(21) Appl. No.: 12/411,981

(22) Filed: Mar. 26, 2009

(65) Prior Publication Data

US 2009/0246466 A1 Oct. 1, 2009

Related U.S. Application Data

(60) Provisional application No. 61/039,522, filed on Mar. 26, 2008.

(51) Int. Cl.

| | |
|---|---|
| ***B05D 5/00*** | (2006.01) |
| ***B05D 7/08*** | (2006.01) |
| ***B05D 3/06*** | (2006.01) |
| ***B05D 3/12*** | (2006.01) |

(52) U.S. Cl. ..... 427/177; 427/508; 427/179; 427/258; 427/408

(58) Field of Classification Search ..... 427/508, 427/146, 150, 258, 408, 177, 179
See application file for complete search history.

(56) References Cited

U.S. PATENT DOCUMENTS

| | | | | |
|---|---|---|---|---|
| 5,580,693 | A * | 12/1996 | Nakajima et al. | 430/200 |
| 6,300,279 | B1 | 10/2001 | Macedo | |
| 6,596,116 | B2 * | 7/2003 | Macedo | 156/230 |
| 6,780,512 | B2 | 8/2004 | Macedo | |
| 6,964,722 | B2 * | 11/2005 | Taylor et al. | 156/230 |
| 7,081,324 | B1 * | 7/2006 | Hare et al. | 430/14 |
| 7,220,705 | B2 * | 5/2007 | Hare | 503/227 |
| 7,799,735 | B2 * | 9/2010 | Segall et al. | 503/227 |
| 2002/0044188 | A1 * | 4/2002 | Codos | 347/106 |
| 2004/0072085 | A1 * | 4/2004 | Horne et al. | 430/9 |
| 2005/0154107 | A1 * | 7/2005 | Li et al. | 524/409 |

* cited by examiner

*Primary Examiner* — William Phillip Fletcher, III

(57) ABSTRACT

The invention relates to a method for heat transferring high resolution digital images that are printed onto a heat transfer sheet with dye-sublimation inks. The dye-sublimated image/design/graphic is impregnated into a natural wood cellulose web material using a rotary heat transfer press. The imaged wood cellulose web material forms a continuous roll of pre-laminate material that can be bonded/laminated to a myriad of substrates and that can be stored easily in roll form, with or without adhesive backing. This is a unique process of formulating an imaged, environmentally sustainable wood cellulose web material. The raw material can be FSC certified from managed renewable forests and after imaging, the wood cellulose web material has no VOC or formaldehyde emissions. The claimed invention preferably uses a polyurethane reactive (PUR) acrylic top coating that provides a high quality and cost effective surface finish to the decorated wood cellulose web material. The PUR system technology provides surface protection with high wear and shock resistance and maintains the depth and quality of the imaged wood cellulose material.

13 Claims, 2 Drawing Sheets

PROCESS FOR DECORATING A WOOD CELLULOSE WEB MATERIAL

This application claims the benefit of the filing date of U.S. Provisional Application Ser. No. 61/039,522 filed Mar. 26, 2008, which is incorporated by reference herein.

SUMMARY OF THE INVENTION

The claimed invention relates to a method of coating (saturating) a web wood cellulose material and heat transferring an imaged dye-sublimated transfer paper to impregnate decorative patterns into cellulose web material. This is a unique process of formulating an imaged, environmentally sustainable wood cellulose material using a roll-to-roll printing method on a rotary heat transfer printer. The imaged wood cellulose material can then be laminated to a myriad of substrates with the advantage of being able to topcoat or stain over the dye-sublimated imaged cellulose material. It incorporates an abrasion resistant surface while maintaining the porous surface to accept dispersed dyes, stains and/or a protective topcoat (e.g., a polyurethane reactive (PUR) acrylic topcoat). The decorated wood cellulose material has no volatile organic/compounds or formaldehyde emissions.

The raw material can be Forest Stewardship Council (FSC) certified from managed renewable forests. In cellulose webs, the wood fibers have been converted into a material that has density and strength properties that compare to natural hardwoods. This natural cellulose web material is made from a number of plies of wood pulp that are determined by the thickness desired.

The wood cellulose material does not need any cross banding to prevent checking and splitting and can conform to curves and bends for contouring applications and wrap molding. The material allows for almost total yield on products, eliminating costly waist and reducing manufacturing costs. Mill workers are no longer restricted to the type of wood grain because of lack of supply and availability. All colors can be adjusted digitally, and all wood grains (including exotic and rare) as well as any custom images can be duplicated and adjusted.

Thus, the present invention relates to a method of heat transferring a printed high resolution image (300 dpi to actual output size) with organic dye sublimation inks onto a transfer sheet. The image is then heat transferred into an acrylic saturated natural wood cellulose continuous web material using a rotary heat transfer printer. In accordance with the method defining the invention, imaged heat transfer paper with dye-sublimating inks is used to transfer/impregnate the images into the acrylic saturated cellulose web material.

The following are the sources of cellulose web materials that accept the dye-sublimation process utilized with the invention process. They are as follows: * Vulcanized (e.g.—Oliner); *Impregnated (e.g.—PolyBak-Richmond Ind.); and * Saturated (e.g.—Neenah Paper).

| | Neenah Paper Inc. | Oliner, Inc. | Richmond Ind. |
|---|---|---|---|
| Physical Properties | Acrylic latex-saturated | Vulcanized | Polyurethane saturated |
| Caliper | 10.4 Mil<br>Wt.-3300 sq. ft. | 10.0 Mil<br>23 lb/cu. ft. | 11.0 Mil<br>64 lb/cu. ft. |
| Dry Tensile MD | 58.9 lbs./inch | 16,000 p.s.i. | 16,400 p.s.i. |
| Dry Tensile CD | 48.9 lbs./inch | 9,000 p.s.i. | 7,000 p.s.i. |
| Dimensional Stability % | 4.5 | 35,000 p.s.i. | 6.0 |

NEENAH PAPER INC., a Michigan based company, manufactures an acrylic, latex saturated natural wood cellulose material. It is made by impregnating/saturating the natural wood pulp with and acrylic latex resin. These resins, used for impregnation, are formed by reacting di-functional acids with di-functional alcohols. The acrylic latex resins are heated in a cauldron to the desired acid number and viscosity. The solution is then transferred to a dip tank. The paper is saturated by dragging it through the dip tank and metered to a final content of 30-49%

OLINER, INC., located in New Jersey, supplies a natural wood cellulose material that is vulcanized and requires an acrylic or polyester topcoat in order to accept the dye-sublimation process. This material is formed by vulcanized fiber made from a number of plies from natural wood pulp. The number of plies determines the thickness. The plies are passed through a bath of zinc chloride. This acid bath forms the surfaces of the individual fibers. Once the fiber plies are bonded together, the zinc chloride is bleached out of the fiber in a series of water baths. The resulting fiber is pure cellulose and is free from any resins and binders.

RICHMOND INDUSTRIES, INC., located in Grand Rapids, Mich. is the manufacturer of PolyBak. PolyBak is manufactured by impregnating Kraft paper liner board with polymer resin using a proprietary system. This resin system contains no formaldehyde and the finished product does not emit any volatile compounds. The polyurethane impregnated material require an acrylic or polyester topcoat in order to accept the dye-sublimation heat transfer process.

Dye-sublimation is the process through which the solid design transforms directly into a gas without going through an intermediate liquid form. The conversion is initiated by heat and controlled with pressure and time. Sublimation Dyes activate or transform from the solid to the gaseous state, beginning at a temperature of about 250° F. As the temperature is increased, the conversion to vapors becomes more rapid, becoming nearly instantaneous ranging from 410-420° F. and a pressure ranging from about 30 psi to 150 psi. The high temperature opens the pores of the polymer and allows for the gas to enter. When the material is removed from the rotary heat transfer press, the temperature drops, the pores close and the gas reverts to a solid state. The dye-sublimated image has now become a part of the wood cellulose web material.

The following companies manufacture examples of dye-sublimation inks that can be used: BASF, Gans, Manupian and Sawgrass and are readily available.—Examples of Sawgrass dye-sublimating inks are: SubliJet IQ, Artainium2-UV+ and SubliM Ink.

The dye-sublimated image printed on the heat transfer paper makes simultaneous contact with the wood cellulose web material with the application of heat and pressure.

Beaver and TexPrint XP and TexPrintXP Plus manufacture examples of dye-sublimation heat transfer paper that are commercially available.

Cellulose webs that can be utilized with the process of the invention can be vulcanized, or impregnated/saturated.

Saturated wood cellulose can be a polyurethane material that has an acrylic or polyester topcoat in order to accept the sublimated dyes. E.g.—PolyBak.

Vulcanized wood cellulose, typically with an acrylic or polyester topcoat in order to accept the dyes. E.g.—Oliner Acrylic saturated wood cellulose—E.g.—Neenah Paper. Additional topcoats are optional. This is the preferred method for the invention. For this embodiment, the plies are passed through a bath of acrylic latex, which forms the surfaces of the individual fibers. This pure cellulose material is now ready to accept the sublimation or heat transfer process. In order for the sublimation dyes to deeply decorate the cellulose web, the vapors formed by heating the dyes must be able to penetrate the surface of the continuous web.

TYPES OF PRINTING PROCESSES that can be used for printing onto heat transfer dye sublimating printing papers include: digital, offset, and gravure printing. The dye-sublimating inks print any design/image using these printing processes.

Digital or direct printing to the transfer paper—used for custom/small production Offset printing which incorporates cylinder and screen—medium production Gravure printing, which is considered high speed and utilizes an engraved copper plated cylinder for transferring sublimation dyes into the transfer paper—large production.

The printing process used in creating high-resolution designs/images onto the heat transfer paper is created electronically. The following are preferred ARTWORK SPECIFICATIONS:

Images are preferably created at a resolution of 300 dpi to actual size required.

Vector Artwork—file format: Illustrator EP; Color Mode—RGB

Pixel Artwork—file format: TIFF or EPS; Color Mode—RGB

Desktop Software using both Mac and PC

Media: DVD, CD

When the continuous web reaches its transition temperature, it expands to form openings to receive the dye. After the sublimation process has occurred and the sublimation dyes have penetrated the surface of the material, the cellulose material and dyes are allowed to cool. This "transition temperature" for the saturated wood cellulose material has porosity similar to polyester fabric. Preferable temperatures are 325 to 410° F., more preferably 375 to 390° F. Pressures at which the process can be conducted range from, preferably, 30 to 150 psi, more preferably 30 to 50 psi. The sublimation dyes are now trapped inside the pores of the web, solidify and the cellulose regains its original form. The transfer sheet is then separated from the web showing the transferred design and is discarded and can be recycled. The dye sublimated imaging process is completed and, unlike decorated film, can be treated as standard wood veneer with a water base stain, sealer or a PUR topcoat, e.g., a polyurethane reactive (PUR) acrylic topcoat.

Examples of manufactures of PUR adhesives: Jowat and Henkel supply polyurethane reactive (PUR) adhesives that are used for laminating/bonding. Kleiberit is the only manufacturer of PUR with an acrylic for top coating.

One advantage of the present invention is that the decorated wood cellulose web can be laminated, as needed, to desired substrates with appropriate adhesives. Examples of substrate materials are: engineered woods, cementitious materials, PVC's, acrylics, and FRP. Adhesives are determined by the substrate that it is to be applied to. For example, for wood, FRP, metal or drywall, a hot melt, cold press or PUR reactive adhesive (all of which are all commercially available) can be used.

The invention accordingly provides a cost efficient method for the imaged material in that it can be stored and shipped easily and inexpensively in roll form, with/without adhesive backing. After the dye sublimation transfer is completed, the imaged wood cellulose web can be rolled, e.g., onto a rewind that has a 3" core.

Moreover the imaged wood cellulose veneer material allows for total yield on products, eliminating costly waste. Wood grains, including exotic and rare as well as any custom design/image/graphics can be duplicated and all colors can be adjusted for wood grains or custom designs.

Material can be marketed to a diverse group of markets, which include commercial, residential, healthcare, hospitality, display, advertising and architectural woodworking.

Examples of products that can be fabricated with the claimed invention include wall and ceiling panels, furniture, wall covering, moldings and flooring.

Characteristics of imaged wood cellulose material include:

high UV stability high resistance to scratch, abrasion and impact mold and mildew resistance—EMSL—M005 high resistance to chemical agents no VOC or formaldehyde emission weather stable water repellent flame retardant—ASTM—E-84—Class A fire-rated Capabilities include:

profile wrapping for moldings, frames, shapes and extrusions membrane pressing for doors and cabinets laminating onto ridged substrates—e.g.—cement board, wood, metal, fiber reinforced polyester (FRP), Acrylic, wood. Products include: wall, ceiling and floor panels.

BRIEF DESCRIPTION OF THE DRAWINGS

Various other features and attendant advantages of the present invention will be more fully appreciated as the same becomes better understood when considered in conjunction with the accompanying drawings, in which like reference characters designate the same or similar parts throughout the several views, and wherein.

DETAILED DESCRIPTION OF DRAWINGS

Rotary Heat Transfer Printer—Roll to Roll Printing

Figure 1:
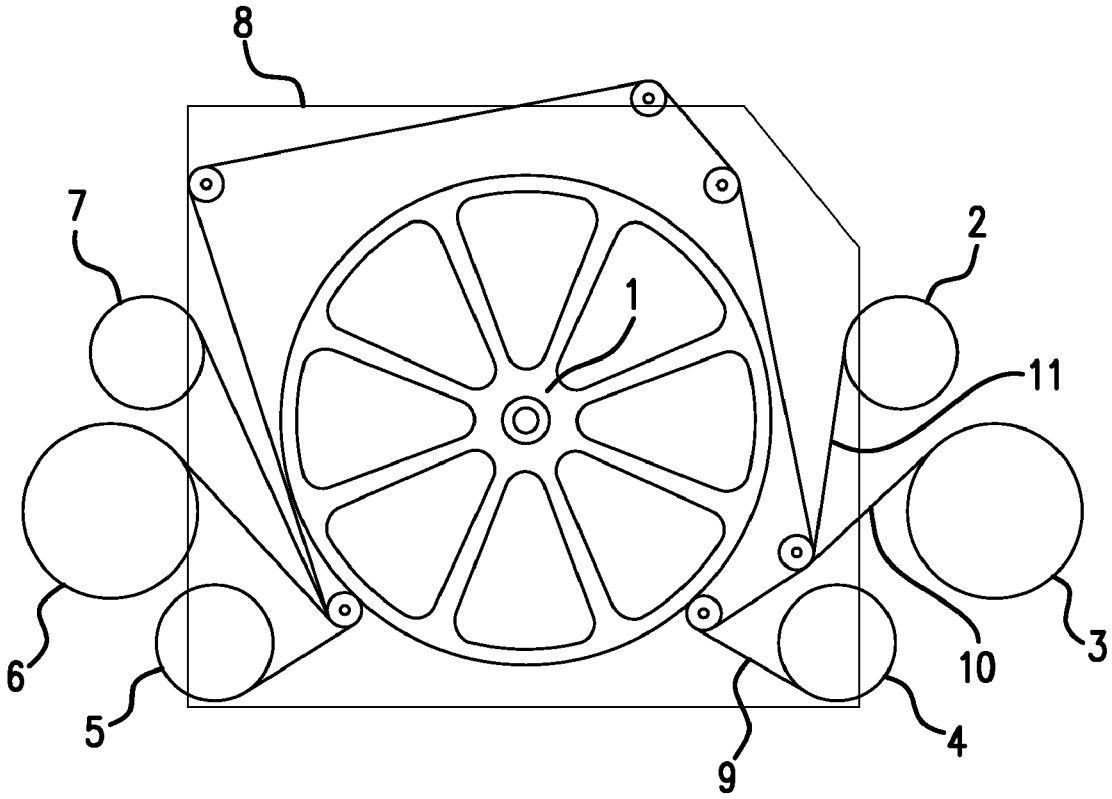
FIG. 1 exemplifies a roll to roll printing process according to the invention.

FIG. 1 A rotary heat transfer printer (8) is used to apply heat and pressure to bring about the sublimation process. The printed transfer paper (9) is placed on the first unwind (4) and meets the cellulose material (10) on a second unwind machine (3). A blotting tissue (11) is immediately placed between the transfer paper and the heated drum so that there is no direct contact with the transfer paper and heated drum. The cycle is completed within a 30 second time period with all three materials being on rewinds (5), (6) and (7) leaving the cellulose material imaged and the exhausted paper discarded for recycling.

Poly Urethane Reactive (PUR) Hot Coating

Figure 2:
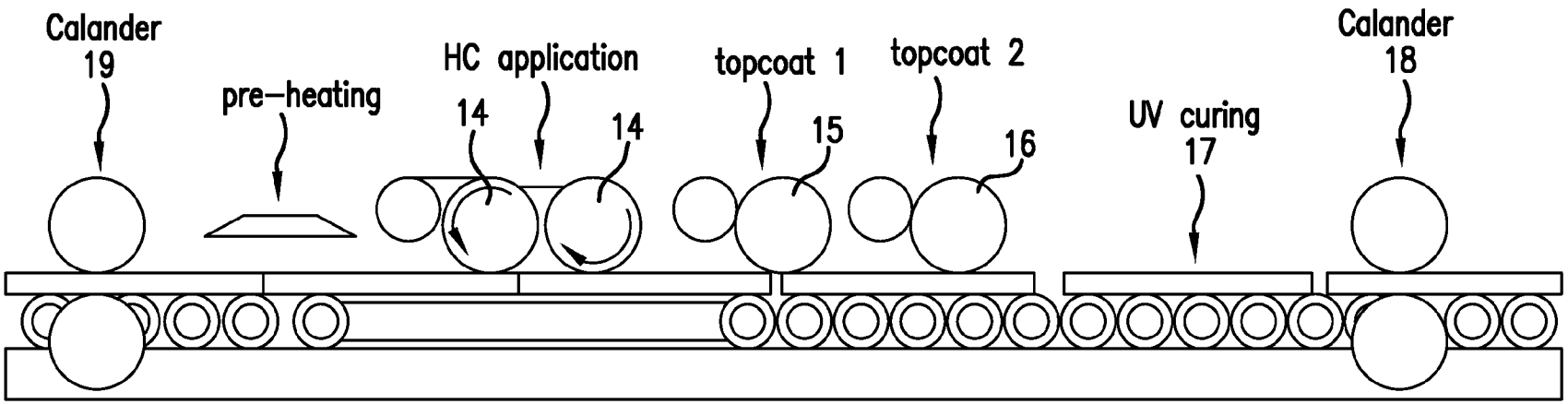
FIG. 2 exemplifies a top coating process of the invention.

FIG. 2: Hot coating provides high quality, cost effective surface finishes. Compact roller application technology enables reproducible surfaces at very high line speeds. Hot coating is 100% solid content and does not contain water or solvents and there are no VOC or formaldehyde emissions.

Kleiberit PUR testing results: *resistant to abrasion-ENV13696; *resistant to chemical agents—EN13442; *resistant to impact—according to ihd-standard 438; scratch hardness—hardness according to ihd-standard 438.

The cellulose web containing the printed reactive dye pattern is passed through a calendar (19) and then under rolls which apply the hot PUR coating in rollers 14 and optionally top coated one or two times in top coat rollers (15) and (16). The material is then subjected to UV curing in a UV curing apparatus (17) and subsequently calendared (18)

A polyurethane reactive material, e.g., PUR HC717-Kleiberit® HotCoating, is solid at room temperature and is molten with the aid of a pre-melter. The PUR is melted, e.g., in a pre-heater (12) between 120 and 150° C. and is then pumped into the application unit through a heated pipe (not shown). The chemical cross-linking of the PUR material achieves is extremely shock and wear resistant. The PUR material also has a very high UV stability and chemical resistance. For flooring application, aluminum oxide can be added to the PUR for additional wear resistance.

Direct application of a UV hardening topcoat (e.g., Kleiberit® acrylic 817) ensures precise setting of the desired gloss level. This application can be repeated, preferably performed twice, and then is UV cured and calendered.

Hot Coating

| *Kleiberit product | Application | Basis | Viscosity at 120* C. at 140* C. | Application temperature | Coat weight | Color |
|---|---|---|---|---|---|---|
| PUR-HC 717.0 Properties | Veneer/ Paper | PUR | 30.000 mPas 15.000 mPas | 100* C.-140* C. | 25-100 g/m2 | transparent |
| *High flexibility *UV resistance UV TopCoat # 817 Properties *Various gloss setting | Topcoat | Acylate | 20 sec (6 mm DIN cup) | 20-30* C. | 5-15 g/m2 | transparent |

From the foregoing description, one skilled in the art can easily ascertain the essential characteristics of this invention, and without departing form the spirit and scope thereof, can make various changes and modifications of the invention to adapt it to various usages and conditions.

The invention claimed is:

1. A roll-to roll method for transferring a sublimation dye design formed on a heat transfer sheet to a wood cellulose web material, comprising the steps:

unwinding the heat transfer sheet from a first supply roll and unwinding the wood cellulose web material from a second supply roll to bring the heat transfer sheet in contact with the wood cellulose web material, and applying heat and pressure to the heat transfer sheet and wood cellulose web material in contact with each other, wherein:

upon application of heat and pressure, the design on the heat transfer sheet penetrates and is thereby transferred to the wood cellulose web material through a sublimation process, and no volatile organic compounds are used and the wood cellulose material showing the transferred design is free of formaldehyde emissions.

2. The method according to claim 1, wherein the method further comprises the step of applying a topcoat to a surface of the wood cellulose web material showing the transferred design.

3. The method according to claim 1, wherein the wood cellulose web material is impregnated with a polymer resin before printing.

4. The method according to claim 3, wherein the polymer resin is an acrylic or polyester.

5. The method according to claim 1, further comprising the step of applying a coating comprising a polyurethane reactive material to a surface of the wood cellulose web material showing the transferred design.

6. The method according to claim 5, wherein the method further comprises the step of applying a UV hardening acrylic to the coating comprising the polyurethane reactive material.

7. The method according to claim 1, wherein the sublimation dye design comprises a digital image.

8. The method according to claim 1, wherein the wood cellulose web material is in the form of a continuous roll before and after printing.

9. The method according to claim 1, wherein heat and pressure are applied at a temperature 325° F. to 410° F. and a pressure ranging from 30 psi to 150 psi, respectively.

10. The method according to claim 1, wherein the method is performed with a rotary heat transfer printer.

11. A roll-to roll method for transferring a sublimation dye design formed on a heat transfer sheet to a wood cellulose web material, comprising the steps:

(a) unwinding the heat transfer sheet from a first supply roll and unwinding the wood cellulose web material from a second supply roll to bring the heat transfer sheet in contact with the wood cellulose web material;

(b) applying heat and pressure to the heat transfer sheet and wood cellulose web material in contact with each other, wherein, upon application of heat and pressure, the design on the heat transfer sheet penetrates and is thereby transferred to the wood cellulose web material through a sublimation process;

(c) applying a coating comprising a polyurethane reactive material to the wood cellulose web material showing the transferred design; and (d) applying a UV hardening acrylic to the coating comprising the polyurethane reactive material, wherein no volatile organic compounds are used and the wood cellulose material showing the transferred design is free of formaldehyde emissions.

12. The method according to claim 11, wherein the wood cellulose web material is impregnated with a polymer resin before printing.

13. The method according to claim 12, wherein the polymer resin is an acrylic or polyester.

* * * * *